US009601839B2

(12) United States Patent
Sakaguchi

(10) Patent No.: US 9,601,839 B2
(45) Date of Patent: Mar. 21, 2017

(54) CRIMPING TERMINAL

(71) Applicant: YAZAKI CORPORATION, Tokyo (JP)

(72) Inventor: Tadahisa Sakaguchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/856,858

(22) Filed: Sep. 17, 2015

(65) Prior Publication Data

US 2016/0013567 A1 Jan. 14, 2016

Related U.S. Application Data

(63) Continuation of application No. PCT/JP2014/056883, filed on Mar. 14, 2014.

(30) Foreign Application Priority Data

Mar. 21, 2013 (JP) ..... 2013-058633

(51) Int. Cl.
*H01R 4/18* (2006.01)
*H01R 4/62* (2006.01)

(52) U.S. Cl.
CPC ..... *H01R 4/18* (2013.01); *H01R 4/185* (2013.01); *H01R 4/188* (2013.01); *H01R 4/62* (2013.01)

(58) Field of Classification Search
CPC ..... H01R 4/18; H01R 4/185; H01R 4/188
See application file for complete search history.

(56) References Cited

U.S. PATENT DOCUMENTS 5,561,267 A 10/1996 Fudoo et al.
7,867,027 B2 * 1/2011 Sakaguchi ..... H01R 4/184 439/585
2002/0076999 A1 6/2002 Chen
(Continued)

FOREIGN PATENT DOCUMENTS

CN 1360368 A 7/2002
CN 102598415 A 7/2012
(Continued)

OTHER PUBLICATIONS

International Search Report for PCT/JP2014/056883 dated Jun. 3, 2014 [PCT/ISA/210].
(Continued)

*Primary Examiner* — Briggitte R Hammond
(74) *Attorney, Agent, or Firm* — Sughrue Mion, PLLC

(57) ABSTRACT

A crimping terminal includes a conductor crimping portion having a U-shaped cross section. The conductor crimping portion includes a base plate portion and a pair of conductor caulking pieces. On an inner surface of the conductor crimping portion, a conductor is disposed, being exposed to a distal end of an aluminum electric wire. The pair of conductor caulking pieces, extending upwardly from both side edges in a longitudinal direction of the base plate portion, are bent inwardly so as to wrap the conductor of the aluminum electric wire to caulk the conductor such that the conductor is in close contact with the inner surface of the base plate portion. On the inner surface of the conductor crimping portion, a protruding indent is provided so as to extend continuously.

6 Claims, 6 Drawing Sheets

(56) References Cited

U.S. PATENT DOCUMENTS

| | | | |
|---|---|---|---|
| 2012/0208409 | A1 | 8/2012 | Endo |
| 2012/0208704 | A1 | 8/2012 | Loew et al. |
| 2012/0214361 | A1 | 8/2012 | Endo |
| 2013/0005197 | A1 | 1/2013 | Sato |
| 2013/0035007 | A1 | 2/2013 | Onuma |
| 2013/0035008 | A1 | 2/2013 | Onuma |
| 2013/0040511 | A1 | 2/2013 | Takashima et al. |
| 2013/0213710 | A1 | 8/2013 | Ohnuma et al. |
| 2014/0004758 | A1 | 1/2014 | Kondou et al. |

FOREIGN PATENT DOCUMENTS

| | | | |
|---|---|---|---|
| CN | 102782940 | A | 11/2012 |
| CN | 102823064 | A | 12/2012 |
| EP | 2555328 | A1 | 2/2013 |
| JP | 56-70975 | U | 6/1981 |
| JP | 3-121661 | U | 12/1991 |
| JP | 7-73950 | A | 3/1995 |
| JP | 2009-152053 | A | 7/2009 |
| JP | 2010-45007 | A | 2/2010 |
| JP | 2010-49985 | A | 3/2010 |
| JP | 2010-123282 | A | 6/2010 |
| JP | 2010-198776 | A | 9/2010 |
| JP | 2011-96451 | A | 5/2011 |
| JP | 2011-96452 | A | 5/2011 |
| JP | 2011-222390 | A | 11/2011 |
| JP | 2011-222394 | A | 11/2011 |
| JP | 2012-69449 | A | 4/2012 |
| JP | 2012-84472 | A | 4/2012 |
| JP | 2012-186100 | A | 9/2012 |
| WO | 2012/050239 | A1 | 4/2012 |

OTHER PUBLICATIONS

Written Opinion for PCT/JP2014/056883 dated Jun. 3, 2014 [PCT/ISA/237].

Communication dated Aug. 9, 2016 from the Japanese Patent Office in counterpart Application No. 2013-058633.

Communication dated Sep. 26, 2016 from the State Intellectual Property Office of the P.R.C. in counterpart application No. 201480016599.6.

Communication dated Nov. 7, 2016 from the German Patent and Trademark Office in counterpart application No. 112014001545.8.

Communication from the Japanese Patent Office dated Jan. 4, 2017 in counterpart Japanese Application No. 2013-058633.

* cited by examiner

CRIMPING TERMINAL

CROSS-REFERENCE TO RELATED APPLICATION

This application is a continuation application of International Application PCT/JP2014/056883, filed on Mar. 14, 2014, and designating the U.S., the entire contents of which are incorporated herein by reference.

BACKGROUND OF THE INVENTION

1. Field of the Invention

The present invention relates to a crimping terminal.

2. Description of the Related Art

As a crimping terminal for an electrical equipment system of an automobile, for example, a crimping terminal of an open barrel type having a conductor crimping portion with substantially a U-shaped cross section has been used. Generally, for caulking this kind of crimping terminal, caulking referred to as B crimp is performed (refer to Japanese Patent Application Laid-open Nos. 2011-96451 and 2011-96452).

As illustrated in FIG. 6, a crimping terminal 501 on which the B crimp is performed includes an electrical connecting portion 507 to be connected to a mating connector, at a front portion in a longitudinal direction of the terminal (that is, a longitudinal direction of a conductor 505 of an electric wire 503 to be connected; refer to FIGS. 7A and 7B). At a rear portion in a longitudinal direction of the terminal, continuing to the electrical connecting portion 507, a conductor crimping portion 509 is provided, which is to be caulked to the conductor 505 that is exposed at a distal end of the electric wire 503. At a further rear portion, provided is a sheath caulking portion 511 to be caulked from the outside of an insulating sheath of the electric wire 503.

The conductor crimping portion 509 is configured to have a substantially U-shaped cross section, together with a base plate portion 513, and with a pair of conductor caulking pieces 515 extending upwardly from both left and right both edges in the longitudinal direction of the base plate portion 513. The pair of conductor caulking pieces 515 are caulked so as to wrap the conductor 505 of the electric wire 503, the conductor 505 being disposed on an inner surface of the base plate portion 513 (refer to FIG. 7A).

When crimping the conductor crimping portion 509 of the crimping terminal 501 to the conductor 505 at the distal end of the electric wire 503, the crimping terminal 501 is disposed on a placement surface (upper surface) of a lower mold (anvil) (not illustrated). Subsequently, the conductor 505 at the distal end of the electric wire 503 is inserted between the pair of conductor caulking pieces 515 of the conductor crimping portion 509, to be disposed on the inner surface of the base plate portion 513. Then, by moving an upper mold (crimper) downwardly relative to the lower mold, the leading end sides of the conductor caulking pieces 515 are gradually folded inwardly at a guide slope of the upper mold.

Then, by further moving the upper mold downwardly relative to the lower mold, the leading ends of the conductor caulking pieces 515 are finally rounded so as to be folded back toward the conductor 505 side on a curved surface ranging from the guide slope of the upper mold to a central angled portion (refer to FIG. 7A). The leading ends of the conductor caulking pieces 515 are bitten into the conductor 505 while being rubbed with each other. With this, the conductor crimping portion 509 comes to be the B crimp in which the pair of conductor caulking pieces 515 have been used to caulk the conductor 505 so as to wrap it to form a B shape (refer to FIG. 7A).

The previously-mentioned B crimp, however is likely to cause infiltration of water from a seam joining portion 517, leading to possible corrosion of the conductor 505. When an aluminum electric wire is used, in particular, an oxide film generated due to corrosion has an insulating property, leading to an increased electric resistance and lowered electrical reliability. Accordingly, when an aluminum electric wire is used, in particular, it is proposed to use, as a form of caulking illustrated in FIG. 7B, an overlap crimping as a countermeasure, in which caulking is performed such that one of the pair of the conductor caulking pieces 515 comes at a lower side, the other overlapping an upper side of the one of the pair, in order to delay the infiltration of water (refer to Japanese Patent Application Laid-open No. 2009-152053).

The overlap crimping, however, compared to the B crimp, has a larger spring back on the conductor caulking pieces 515 at the time of crimping, as illustrated in arrow a direction in FIG. 7B. As a result, it is likely to cause a decrease in a caulking force at the conductor crimping portion 509, leading to a decrease in fixing strength, or a decrease in crimping performance such as a rise in electric resistance. Furthermore, overlap crimping has low rigidity in a caulking portion, leading to an occurrence of a gap S at on an overlapping surface, as illustrated in FIG. 7B, in response to the ambient temperature changes. For these reasons, it is desired to supply an overlap crimping with further improved electrical reliability.

SUMMARY OF THE INVENTION

The present invention has been made in view of the above circumstances, and its object is to provide a crimping terminal that can enhance crimping performance and improve electrical reliability.

In order to solve the above mentioned problem and achieve the object, a crimping terminal according to one aspect of the present invention includes a conductor crimping portion having a U-shaped cross section, the conductor crimping portion including a base plate portion on an inner surface of which a conductor is disposed, the conductor being exposed to a distal end of an electric wire, and a pair of conductor caulking pieces extending upwardly from both side edges in a longitudinal direction of the base plate portion and having been bent inwardly so as to wrap the conductor to caulk the conductor such that the conductor is in close contact with the inner surface of the base plate portion, wherein on the inner surface of the conductor crimping portion on which caulking is performed such that one of the pair of the conductor caulking pieces comes at a lower side, the other of the pair of the conductor caulking pieces overlapping an upper side of the one of the pair of the conductor caulking pieces, a protruding indent is provided so as to extend continuously at least from each of the corner portions between the base plate portion and the conductor caulking pieces, across the base plate portion and the conductor caulking pieces, in a direction intersecting with the longitudinal direction.

Furthermore, the crimping terminal according to another aspect of the present invention is a crimping terminal configured as above, and may include the indent provided alongside in a plurality of rows in the longitudinal direction.

Furthermore, the crimping terminal according to still another aspect of the present invention is the crimping terminal configured as above, in which the electric wire may be an aluminum electric wire having a conductor made of aluminum or aluminum alloy.

The present invention has been briefly described as above. Embodiments for implementing the present invention (hereinafter, embodiment or embodiments) will now be described below with reference to the accompanying drawings. Reading through this will further clarify details of the present invention.

DETAILED DESCRIPTION OF THE PREFERRED EMBODIMENTS

Embodiments according to the present invention will now be described with reference to the drawings.

Figure 1:
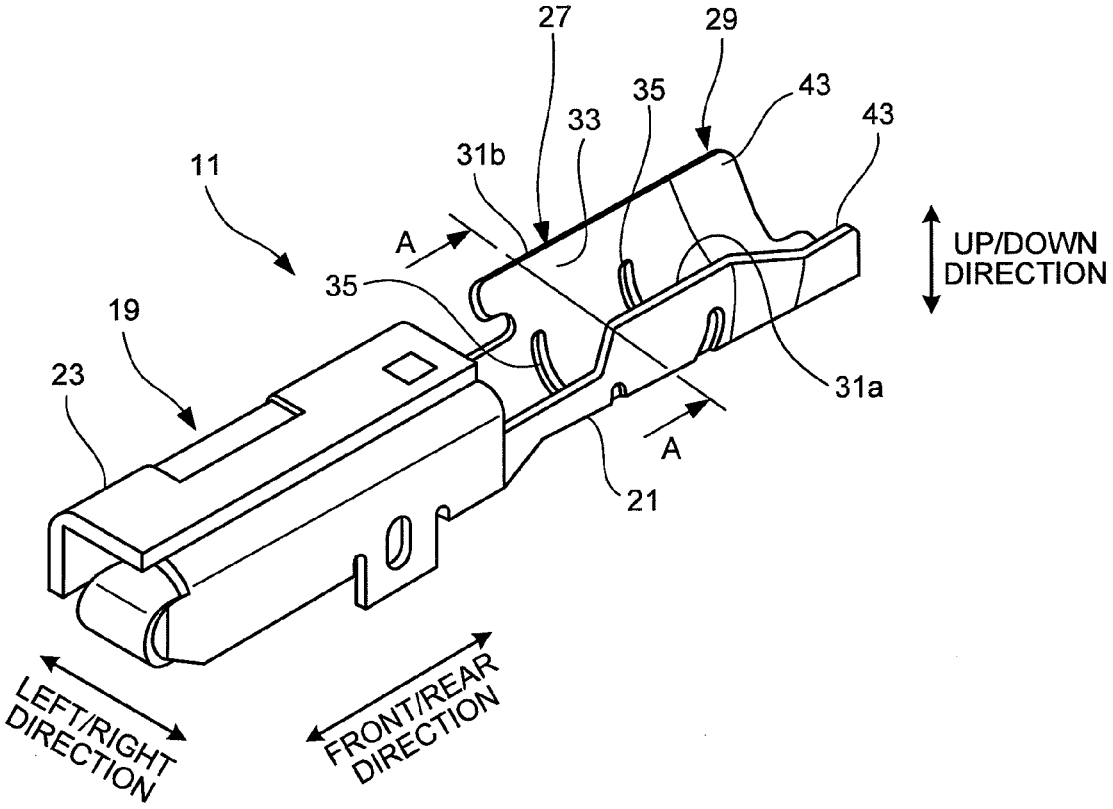
FIG. 1 is a perspective view of a crimping terminal before a conductor is crimped, according to an embodiment of the present invention.
Figure 2:
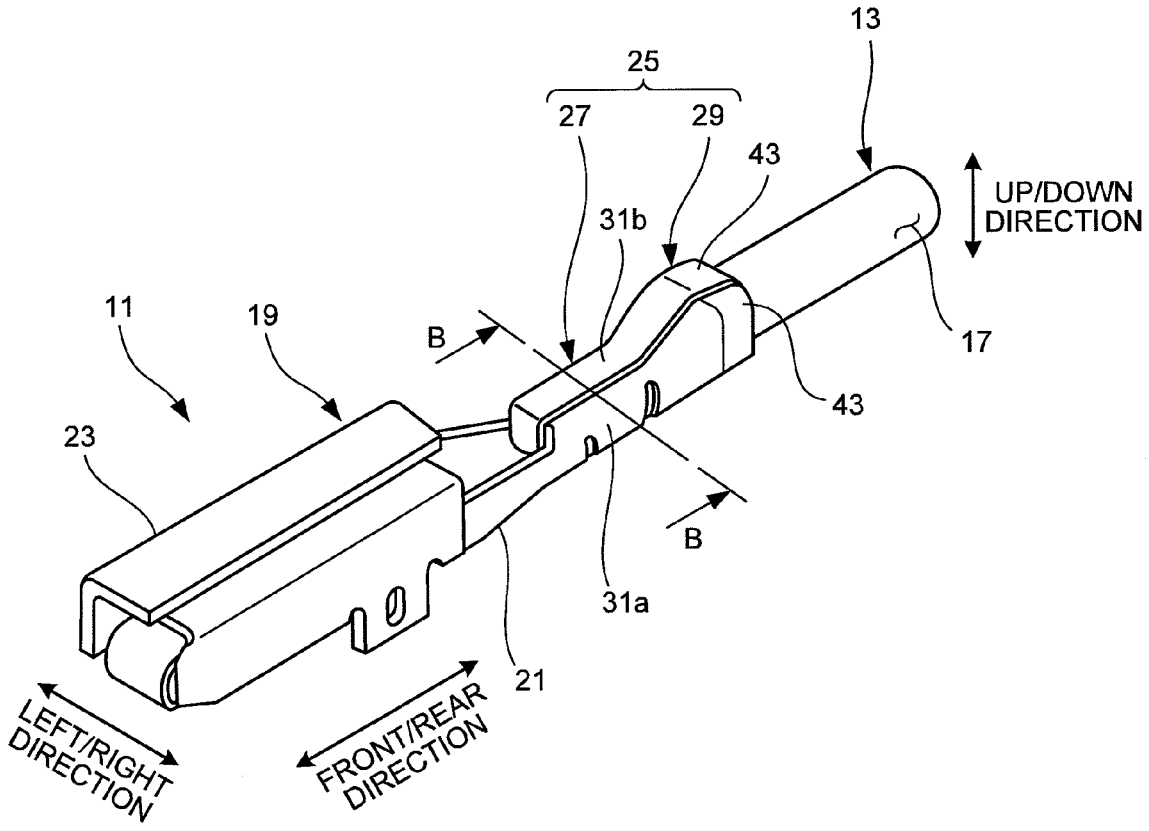
FIG. 2 is a perspective view of the crimping terminal illustrated in FIG. 1, after a conductor has been crimped.

A crimping terminal 11 illustrated in FIGS. 1 and 2, according to an embodiment of the present invention, is connected to a distal end of an aluminum electric wire (electric wire) 13. The aluminum electric wire 13 is a conductor 15 (refer to FIG. 3B or others) made of a plurality of aluminum or aluminum alloy strands being twisted together, with the outer periphery of the conductor being covered with an insulating sheath 17. At an end portion of the aluminum electric wire 13, the insulating sheath 17 has been removed by a predetermined length, exposing the conductor 15. The crimping terminal 11 is to be crimp-connected to this end portion. Specific examples of preferable aluminum alloy include an alloy of aluminum and iron. When this type of alloy is adopted, it is possible to enhance extendibility and strength (tensile strength, in particular), compared with the conductor 15 made of aluminum.

As illustrated in FIG. 1, the crimping terminal 11 according to the present embodiment includes a terminal main body 19 made of conductive metal. The terminal main body 19 includes a base plate portion 21, an electrical connecting portion 23, and an electric wire holding portion 25. The base plate portion 21 is provided in a longitudinal direction of the terminal main body 19 (hereinafter, a first direction described above is also referred to as a "front/rear direction", a second direction orthogonal to the front/rear direction is also referred to as a "left/right direction", and a third direction orthogonal to the front/rear direction and the left/right direction, is also referred to as an "up/down direction"). The electrical connecting portion 23, provided at a front portion of the front/rear direction, connects electrically to a mating terminal with fitting contact. The electric wire holding portion 25 is provided at a rear end portion of the front/rear direction to hold the aluminum electric wire 13. As used herein, the crimping terminal 11 is made of copper or copper alloy, for example. The surface of the terminal main body 19 may be coated with tin (Sn). The terminal main body 19 is formed by press working on a plate material made of copper or copper alloy having a fixed thickness. As used herein, a front side of the crimping terminal 11 typically corresponds to a side where the mating terminal is positioned when connected with the mating terminal. In other words, it corresponds to a leading end side of the conductor 15 that is exposed from the insulating sheath 17, in the extending direction (namely, front/rear direction) of the aluminum electric wire 13. On the other hand, a rear side of the crimping terminal 11 typically corresponds to a side opposite to the side where a mating terminal is positioned when connected with the mating terminal. In other words, it corresponds to proximal end side of the conductor 15 that is exposed from the insulating sheath 17, in the extending direction of the aluminum electric wire 13.

The electric wire holding portion 25 includes, at its front side, a conductor crimping portion 27 for caulking the conductor 15 for the aluminum electric wire 13. The electric wire holding portion 25 includes, at its rear side of the conductor crimping portion 27, a sheath caulking portion 29 for fixing the aluminum electric wire 13 to the terminal main body 19 by caulking the insulating sheath 17 of the aluminum electric wire 13. The conductor crimping portion 27 and the sheath caulking portion 29 are provided continuously. Note that the electrical connecting portion 23, the conductor crimping portion 27, and the sheath caulking portion 29 are each configured to contain the base plate portion 21.

The conductor crimping portion 27 is configured integrally with the terminal main body 19, so as to extend upwardly from the both side edges in the longitudinal direction of the base plate portion 21. As used herein, the upward direction means the side where the electric wire holding portion 25 opens in the up/down direction before crimping of the conductor, namely, the side where the aluminum electric wire 13 is provided. As illustrated in FIG. 2, the conductor crimping portion 27 includes a pair of conductor caulking pieces 31*a* and 31*b* for crimp-connecting the aluminum electric wire 13 to the terminal main body 19. The conductor caulking pieces 31*a* and 31*b* are bent inwardly on the terminal main body 19 so as to wrap the conductor 15 of the aluminum electric wire 13, in order to caulk the conductor 15 such that the conductor 15 is in close contact with an inner surface of the base plate portion 21. The conductor crimping portion 27, having part of the base plate portion 21 sandwiched between the pair of conductor caulking pieces 31*a* and 31*b*, is formed to have a U-shaped cross section. On the inner surface of the base plate portion 21, the conductor 15, having been exposed to the distal end of the aluminum electric wire 13, is disposed. The pair of conductor caulking pieces 31*a* and 31*b*, extending upwardly from both side edges in the longitudinal direction of the base plate portion 21, are bent inwardly so as to wrap the conductor 15 to caulk the conductor 15 such that the conductor 15 is in close contact with the inner surface of the base plate portion 21.

On an inner surface 33 of the conductor crimping portion 27, a protruding indent 35 is provided so as to extend continuously at least from corner portions 37 (refer to FIG. 3B) between the base plate portion 21 and the conductor caulking pieces 31*a* and 31*b*, across the base plate portion 21 and the conductor caulking pieces 31*a* and 31*b*, in a direction intersecting with the longitudinal direction.

Figure 4A:
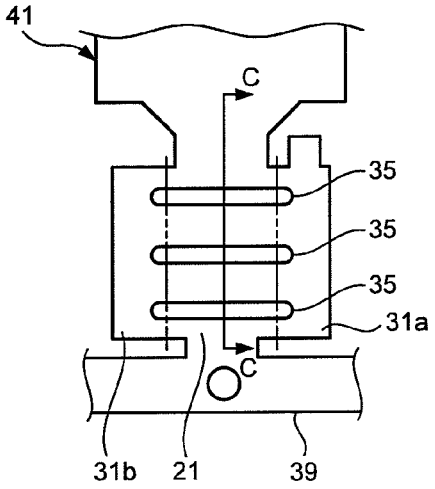
FIG. 4A is a plan view of a conductor crimping portion, before being bent, having a plurality of indents.

The crimping terminal 11 according to the present embodiment is manufactured, as illustrated in FIG. 4A, for example, by press working in series on a metal plate, being joined to a carrier 39 at a rear end portion. A crimping terminal development portion is joined to a carrier 39. The crimping terminal development portion is formed into a terminal-shaped plate in a flat developed state (development raw plate 41) by press punching a metal plate.

Figure 3A:
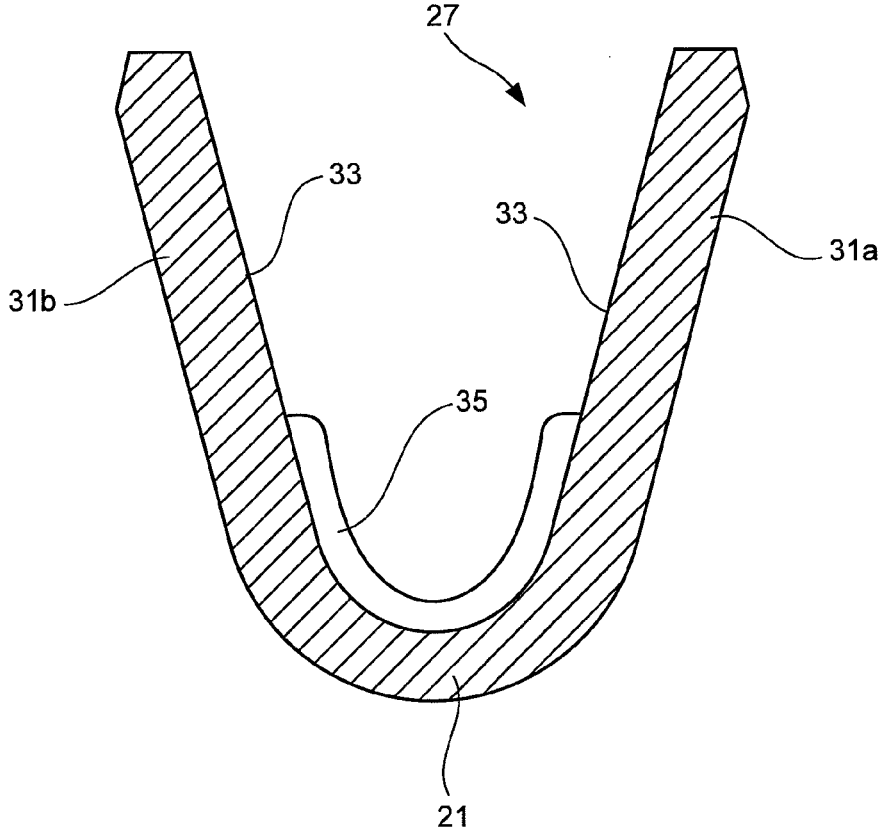
FIG. 3A is an A-A cross-sectional view of FIG. 1.
Figure 3B:
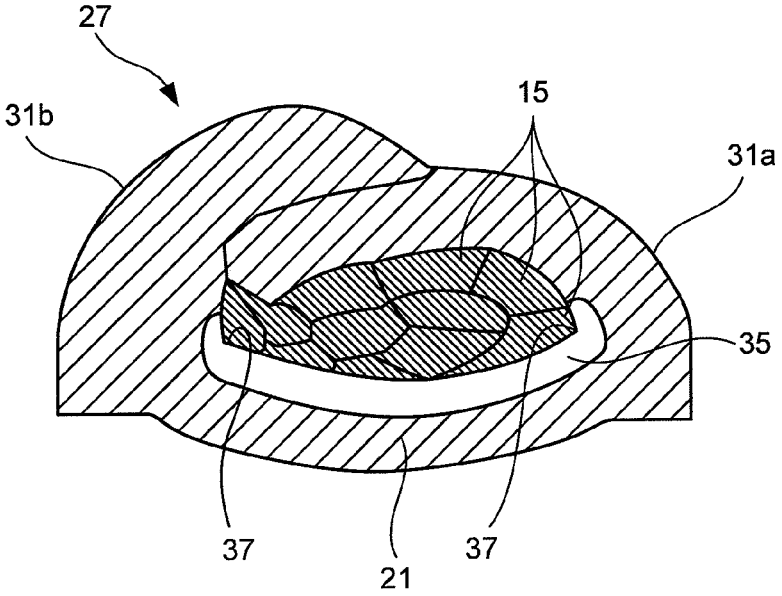
FIG. 3B is a B-B cross-sectional view of FIG. 2.

The crimping terminal 11 is manufactured by press working on the development raw plate 41. The conductor crimping portion 27 of the crimping terminal 11 can be appropriately formed, for example, by U-shape bending. With U-shape bending, the base plate portion 21 of the conductor crimping portion 27 is formed by a flat portion of a die base. Accordingly, at the conductor crimping portion 27 of the crimping terminal 11, the corner portions 37 with various sizes of bending radius are formed between the base plate portion 21 which is flat, and the conductor caulking pieces 31*a* and 31*b*, as illustrated in FIG. 3B. A dashed-two dotted line in FIGS. 4A to 4C indicates a central position of the corner portion 37, illustrated with a virtual line, which is to be a margin between the base plate portion 21 and the conductor crimping portion 27, on the U-shaped cross section.

Figure 4B:
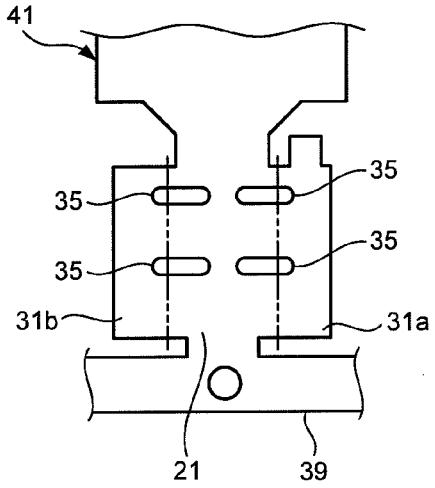
FIG. 4B is a plan view of a conductor crimping portion, before being bent, in which indents are divided in an extending direction.
Figure 4C:
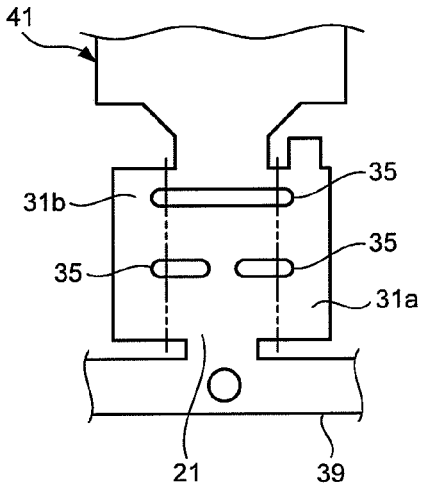
FIG. 4C is a plan view of a conductor crimping portion, before being bent, in which a long indent and a divided indent are provided together.

The indent 35 protrudingly formed on the inner surface 33 of the conductor crimping portion 27 can be provided alongside in a plurality of rows in the longitudinal direction of the base plate portion 21. According to the present embodiment, the indent 35 with the same length is provided in a plurality of rows (three rows in the exemplary figure) with predetermined intervals in the front/rear direction as illustrated in FIG. 4A. The indent 35 may obviously be divided into a plurality of indents (two in the exemplary figure) in the extending direction, as illustrated in FIG. 4B. Furthermore, the indent 35 may be provided such that a long-length indent 35 and a divided indent 35 are provided together, as illustrated in FIG. 4C.

On the inner surface 33 of the conductor crimping portion 27 according to the present embodiment, a serration (shallow groove stamped out in a form of a pressed line) has not been formed. The reason is that the indent 35 protrudingly formed on the inner surface 33 of the conductor crimping portion 27 can enhance the restraining force against the pull-out direction of the conductor 15, similarly as a case of a ordinarily-provided serration. Configuration without any serration prevents rigidity deterioration in the conductor crimping portion 27 which would be made thinner with serration. Note that, in the crimping terminal according to the present invention, a serration may be understandably provided together with the indent 35 on the inner surface of the conductor crimping portion.

The sheath caulking portion 29 is configured integrally with the conductor crimping portion 27, so as to extend upwardly from the both side edges in the left/right direction of the base plate portion 21. The sheath caulking portion 29 includes a pair of sheath caulking pieces 43. The pair of sheath caulking pieces 43 are bent inwardly on the terminal main body 19 so as to wrap the insulating sheath 17 of the aluminum electric wire 13 in order to caulk and fix the aluminum electric wire 13. The sheath caulking portion 29 is formed to have a U-shaped cross section, with part of the base plate portion 21 sandwiched between the pair of sheath caulking pieces 43.

The crimping terminal 11 according to the present embodiment, after being formed into a shape as illustrated in FIG. 1 by press working, is connected to the end portion of the aluminum electric wire 13.

When crimp-connecting the conductor crimping portion 27 of the crimping terminal 11 to the conductor 15 of the aluminum electric wire 13, the crimping terminal 11 is disposed on a placement surface (upper surface) of a lower mold (anvil) (not illustrated).

Next, the conductor 15, which has been exposed at the distal end of the aluminum electric wire 13, is inserted between the pair of conductor caulking piece 31*a* and 31*b* of the conductor crimping portion 27, and is then disposed on the inner surface of the base plate portion 21.

Then, by moving an upper mold (crimper) downwardly relative to the lower mold, the leading end side of the conductor caulking piece 31*a* (one of the pair) and the leading end side of the sheath caulking piece 43 (one of the pair) are gradually folded inwardly at a guide slope of the upper mold. Similarly, the leading end side of the conductor caulking piece 31*b* (the other of the pair) and the leading end side of the sheath caulking piece 43 (the other of the pair) are gradually folded inwardly at a guide slope of the other upper mold so as to overlap the conductor caulking piece 31*a* (the one of the pair) and the sheath caulking piece 43 (the one of the pair). Note that the pair of conductor caulking pieces 31*a* and 31*b* and the pair of sheath caulking pieces 43 may be simultaneously folded inwardly, by using the upper mold having a guide slope of an inverted V-shape with different angles in left and right sides.

Subsequently, further moving the upper mold downwardly relative to the lower mold causes the pair of conductor caulking pieces 31*a* and 31*b* to wrap the conductor 15 finally with the guide slope of the upper mold, and at the same time, causes the pair of sheath caulking pieces 43 to be rounded to wrap the insulating sheath 17. As a result, the conductor crimping portion 27 is overlap-crimped by the pair of conductor caulking pieces 31*a* and 31*b* such that the conductor 15 is caulked so as to be wrapped inside a cylindrical portion, as illustrated in FIG. 3B (caulking is performed such that the conductor caulking piece 31*a* comes at a lower side, the conductor caulking piece 31*b* overlapping the upper side of the conductor caulking piece 31*a*). This crimp-connects the conductor 15 to the conductor crimping portion 27. At the same time, it is possible to obtain a crimping structure in which the insulating sheath 17 of the aluminum electric wire 13 has been caulked to the sheath caulking portion 29.

Operation of the crimping terminal 11 having the above configuration will be described in the following.

In the crimping terminal 11 according to the present embodiment, at the corner portions 37 between the base plate portion 21 and the conductor caulking pieces 31*a* and 31*b* on the inner surface 33 of the conductor crimping portion 27, a protruding indent 35 is formed across the base plate portion 21 and the conductor caulking pieces 31*a* and 31*b*, extending continuously in a direction intersecting with the longitudinal direction of the base plate portion 21. As used herein, the corner portions 37 are the portions made from the base plate portion 21 and the conductor caulking pieces 31*a* and 31*b* that have been bent to become outward protrusions. The indent 35 is a projection that has been hammered out such that a leading end thereof protrudes on the inner surface 33 of the conductor crimping portion 27.

Figure 5:
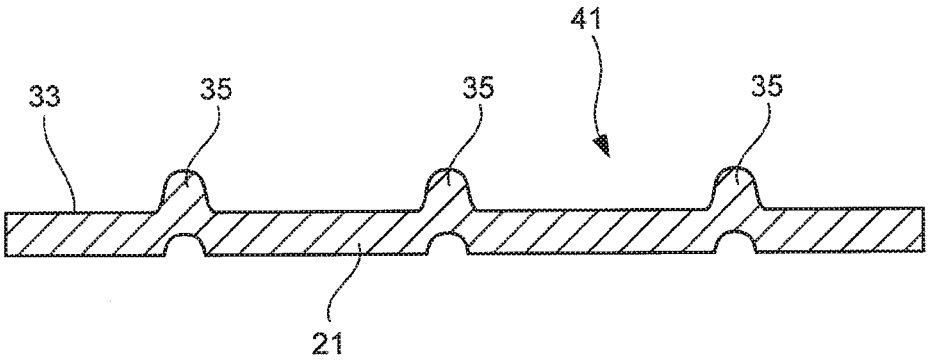
FIG. 5 is a C-C cross-sectional view of FIG. 4A.
Figure 6:
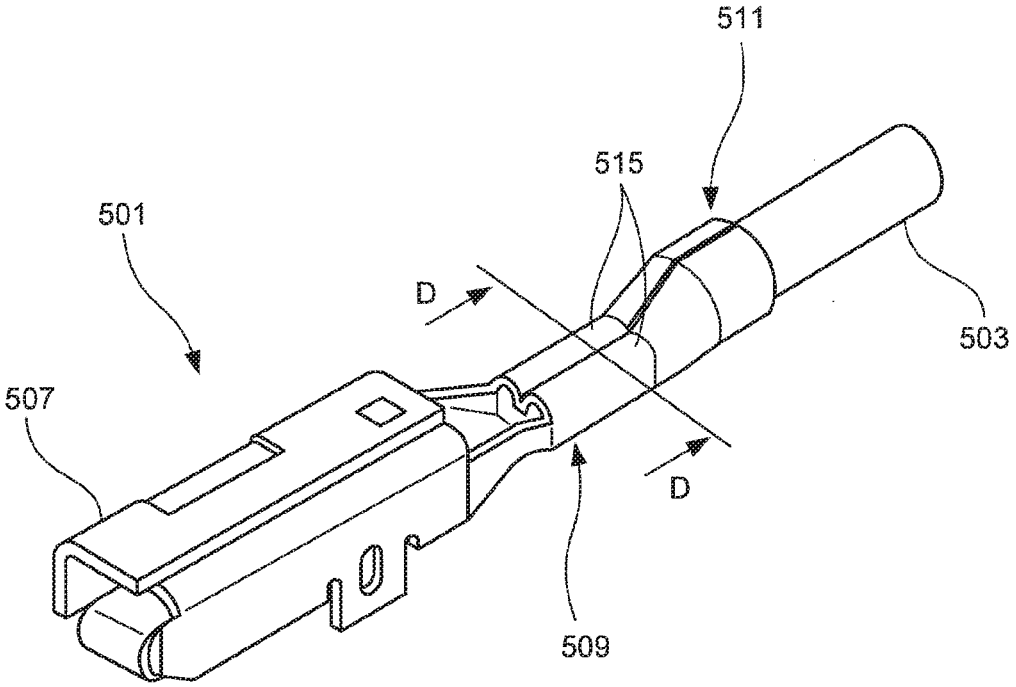
FIG.6 PRIOR ART
FIG. 6 is a perspective view of a conventional crimping terminal to which a conductor has been crimped using B crimp.

The indent 35, in a state of the development raw plate 41, as illustrated in FIG. 5, has the leading end with a curved cross-sectional surface protruding on the inner surface 33 of the conductor crimping portion 27.

The protruding indent 35 according to the present embodiment differs from a serration formed as a shallow groove stamped out only on one surface in a form of a pressed line. In an ordinary serration, a thickness in a portion on which the serration has been formed becomes smaller, causing the conductor crimping portion 27 to easily stretch in an axial direction when crimped.

The protruding indent 35, after being protrudingly formed across the base plate portion 21 and the conductor caulking pieces 31*a* and 31*b*, of the development raw plate 41 die-cut from a sheet metal (aluminum alloy sheet made from ordinary corrosion-resistant aluminum alloy or high-strength aluminum), is bent with the protruding side of the indent 35 facing inwardly, together with the conductor caulking pieces 31*a* and 31*b*, as illustrated in FIG. 3B. As a result, the conductor crimping portion 27 is formed, in which the indent 35 is provided on the corner portions 37 existing between the base plate portion 21 and the conductor caulking pieces 31*a* and 31*b*.

According to the present embodiment, it is essential that the indent 35 at least includes the corner portions 37. The indent 35, as illustrated in FIG. 3B, for example, preferably extends both onto the base plate portion 21 and onto the conductor caulking pieces 31*a* and 31*b*, from the corner portions 37, for obtaining greater strength. Note that, in configuration, the indent 35 extending over the base plate portion 21 may be formed to include the corner portions 37, and the end of the indent 35 may be connected to the boundary with the conductor caulking pieces 31*a* and 31*b*. The reason is this also enhances the strength in the corner portions 37.

Figure 7A:
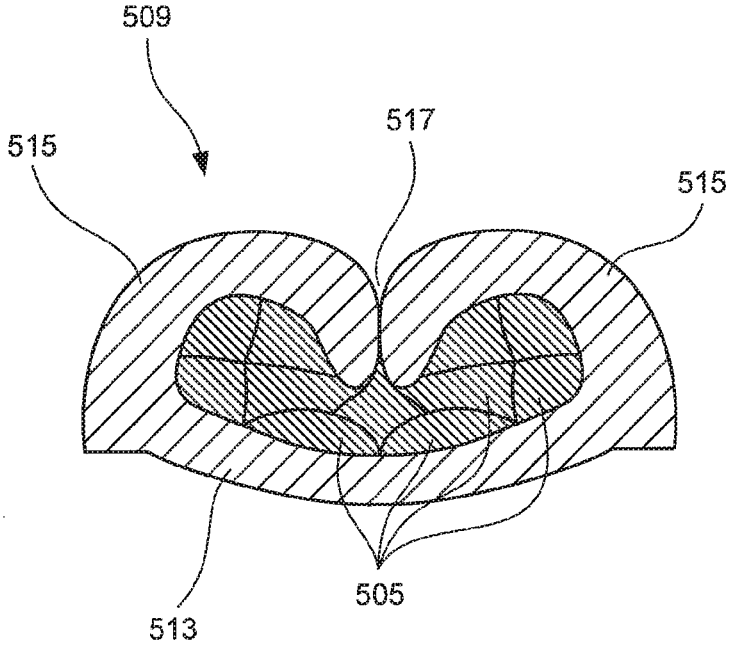
FIG.7A PRIOR ART
FIG. 7A is a D-D cross-sectional view of FIG. 6.
Figure 7B:
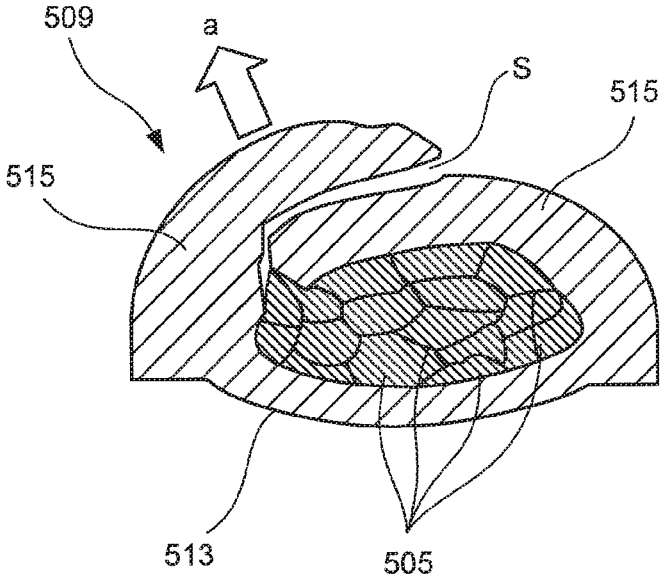
FIG.7B PRIOR ART
FIG. 7B is a cross-sectional view of main portions of a conventional conductor crimping portion in which overlap crimping has been performed.

In this way, on the conductor crimping portion 27 in which higher rigidity has been achieved in the corner portions 37 existing between the base plate portion 21 and the conductor caulking pieces 31*a* and 31*b*, the conductor 15 of the aluminum electric wire 13 is disposed at the base plate portion 21. Then, the pair of conductor caulking pieces 31*a* and 31*b* are overlap-crimped so as to wrap the conductor 15 (caulking is performed such that one of the pair of the conductor caulking pieces 31*a* and 31*b* comes at a lower side, the other of the conductor caulking pieces 31*a* and 31*b* overlapping an upper side of the one of the pair of the conductor caulking pieces 31*a* and 31*b*). In the caulked conductor crimping portion 27, a conductive metal and the conductor 15 adhere to each other (bound at a molecular or atomic level). At this time, with the protruding indent 35 having been formed on the inner surface 33 of the conductor crimping portion 27, the corner portions 37, existing between the base plate portion 21 and the conductor caulking pieces 31*a* and 31*b*, have obtained higher rigidity, and have achieved enhanced caulking force at the conductor crimping portion 27, making it possible to obtain higher crimping performance. Also, the spring back can be suppressed to a low level. Furthermore, higher rigidity obtained in the corner portions 37 may prevent a gap from occurring even when the ambient temperature changes. Accordingly, it is possible to obtain the equivalent or higher level of crimping performance as of the B crimp. As a result, the overlapping portion of the conductor crimping portion 27 does not easily cause a gap (opening) S such as in the case of conventional conductor crimping portion 509 without having the indent 35 as illustrated in FIG. 7B.

With the crimping terminal 11 according to the present embodiment, arranging indents 35 alongside in the plurality of rows in the extending direction, namely, the longitudinal direction, of the aluminum electric wire 13, can achieve higher rigidity in the corner portions 37 between the base plate portion 21 and the conductor caulking piece 31*a* and 31*b*, making it possible to obtain higher crimping performance. Furthermore, the indent 35, intersecting with the conductor 15, can enhance a pull-out strength of the conductor 15 from the conductor crimping portion 27.

Furthermore, with the crimping terminal 11 according to the present embodiment, since application has been performed to the aluminum electric wire 13 having the conductor 15 made of aluminum or aluminum alloy, crimping operation can be performed without causing excessive load on the conductor 15 made of aluminum or aluminum alloy, which has lower level of strength and ductility compared with the conductor made of copper. In addition, since the crimping terminal 11 can reliably prevent the conductor caulking pieces 31*a* and 31*b* from opening, it is possible to obtain a higher crimping force in the crimping terminal 11 toward the conductor 15 made of aluminum or aluminum alloy, which has lower level of conductivity compared with the conductor made of copper, leading to improved electrical connection performance.

Furthermore, according to the present embodiment, the terminal main body 19 made by tin-plated copper or copper alloy is used, making it possible to enhance adhesion of the terminal main body surface to the conductor 15 that is made of tin-aluminum alloy, leading to improved electrical connection performance. In particular, by using the crimp-connection, tin on the terminal main body surface fills the gaps between each of aluminum-alloy strands that form the conductor 15 while adhering to the surface of the strands. Therefore, it is possible to broaden a contact area between the strands, and between the strand and the terminal, and to lower the contact resistance. Furthermore, due to plastic deformation at the time of crimp-connection, an oxide film on the surface of the conductor crimping portion 27 is broken, causing a new metal surface of the plated tin to adhere to the conductor 15 of the aluminum electric wire 13, making it possible to obtain a gas-tight structure, thereby improving the contact reliability.

As a result, with the crimping terminal 11 according to the embodiment of the present invention, it is possible to obtain higher crimping performance and improve electrical reliability.

According to a crimping terminal having the above configuration, at corner portions between a base plate portion and conductor caulking pieces on an inner surface of the conductor crimping portion, a protruding indent is formed, extending continuously across the base plate portion and the conductor caulking pieces in a direction intersecting with the longitudinal direction of the base plate portion. The indent is a projecting ridge that has been hammered out such that a leading end thereof protrudes on the inner surface of the conductor crimping portion. This differs from a serration formed as a shallow groove stamped out only on one surface in a form of a pressed line. Sheet metal has low strength as it is made as a flat surface and thus is easily strained. It obtains greater strength (rigidity against strain), however, when protruding indent has been formed on it. On the conductor crimping portion in which higher rigidity has been achieved in the corner portions existing between the base plate portion and the conductor caulking pieces, a conductor of an electric wire is disposed at the base plate portion. Then, a pair of conductor caulking pieces are overlap-crimped so as to wrap the conductor (caulking is performed such that one of the pair of the conductor caulking pieces comes at a lower side, the other of the caulking pieces overlapping an upper side of the one of the pair of the conductor caulking pieces). In the conductor crimping portion that has been caulked, conductive metal and a conductor adhere to each other. At this time, with the protruding indent having been formed on the inner surface of the conductor crimping portion, the corner portions, existing between the base plate portion and the conductor caulking pieces, have obtained higher rigidity, and have achieved enhanced caulking force at the conductor crimping portion, making it possible to obtain higher crimping performance. Also, the spring back can be suppressed to a low level. Furthermore, higher rigidity obtained in the corner portions may prevent a gap from occurring even when the ambient temperature changes. Accordingly, the overlapping portion of the conductor crimping portion does not easily cause opening.

According to the crimping terminal having the above configuration, arranging indents alongside in the plurality of rows in the extending direction, namely, the longitudinal direction, of the electric wire, can achieve higher rigidity in the corner portions between the base plate portion and the conductor caulking pieces, making it possible to obtain higher crimping performance. Furthermore, the indent, intersecting with the conductor, can enhance a pull-out strength of the conductor from the conductor crimping portion.

According to a crimping terminal having the above configuration, since the crimping terminal has been applied to an aluminum electric wire having a conductor made of aluminum or aluminum alloy, it is possible to perform crimping operation without causing excessive load on a conductor made of aluminum or aluminum alloy having lower level of strength and ductility compared with the conductor made of copper. Furthermore, since the crimping terminal can reliably prevent the conductor caulking pieces from opening, it is possible to obtain higher crimping force in the terminal for a conductor made of aluminum or aluminum alloy having low level of conductivity compared with the conductor made of copper, leading to improved electrical connection performance.

With the crimping terminal according to the present invention, it is possible to enhance crimping performance and improve electrical reliability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimping terminal comprising a conductor crimping portion having a U-shaped cross section, the including:

a base plate portion on an inner surface of which a conductor is disposed, the conductor being exposed to a distal end of an electric wire, a pair of conductor caulking pieces extending upwardly from both side edges in a longitudinal direction of the base plate portion and having been bent inwardly so as to wrap the conductor to caulk the conductor such that the conductor is in direct contact with the inner surface of the base plate portion and the conductor caulking pieces, and a pair of corner portions respectively arranged between the base plate and a respective one of the pair of conductor caulking pieces, wherein on the inner surface of the conductor crimping portion on which caulking is performed such that one of the pair of the conductor caulking pieces comes at a lower side, the other of the pair of the conductor caulking pieces overlapping an upper side of the one of the pair of the conductor caulking pieces, a protruding indent is provided so as to extend continuously at least from each of the corner portions between the base plate portion and the conductor caulking pieces, across the base plate portion and onto each of the conductor caulking pieces, in a direction intersecting with the longitudinal direction, and wherein the protruding indent extends across each corner portion of the pair of corner portions.

2. The crimping terminal according to claim 1, wherein the indent comprises a plurality of indents arranged alongside each other in a plurality of rows in the longitudinal direction.

3. The crimping terminal according to claim 1, wherein the electric wire is an aluminum electric wire including the conductor made of aluminum or aluminum alloy.

4. The crimping terminal according to claim 2, wherein the electric wire is an aluminum electric wire including the conductor made of aluminum or aluminum alloy.

5. The crimping terminal according to claim 2, wherein the plurality of indents comprises at least three indents having a same length, and wherein the plurality of rows are spaced apart at a predetermined interval.

6. The crimping terminal according to claim 5, wherein at least one of the plurality of indents is a divided indent, such that the at least one of the plurality of indents is divided into a plurality of sub-indents in the direction intersecting with the longitudinal direction.

* * * * *